US006327879B1

(12) United States Patent
Malsom

(10) Patent No.: US 6,327,879 B1
(45) **Date of Patent: *Dec. 11, 2001**

(54) LOCKING MECHANISM FOR SLIDING GLASS DOORS

(75) Inventor: Harlan Malsom, Pella, IA (US)

(73) Assignee: Pella Corporation, Pella, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,617

(22) Filed: Sep. 11, 1997

(51) Int. Cl.[7] ..... E05B 65/08

(52) U.S. Cl. ..... 70/97; 70/100; 292/49; 292/51; 292/197; 292/199; 292/210; 292/229; 292/241; 292/DIG. 46

(58) Field of Search ..... 70/97, 98, 90, 70/95, 96, 99, 100; 292/DIG. 46, 215, 229, 197, 199, 241, 51, 49, 210, 336

(56) References Cited

U.S. PATENT DOCUMENTS

| | | | | |
|---|---|---|---|---|
| 1,143,653 | * | 6/1915 | Smith | 70/97 |
| 1,320,444 | * | 11/1919 | Buczynski et al. | 70/97 |
| 2,668,071 | * | 2/1954 | Adams et al. | 70/97 |
| 2,712,464 | * | 7/1955 | Collar et al. | 292/DIG. 46 X |
| 2,736,185 | * | 2/1956 | Collar | 292/DIG. 46 X |
| 2,777,721 | * | 1/1957 | Burke et al. | 292/216 X |
| 2,833,578 | * | 5/1958 | Burke | 292/216 X |
| 2,861,660 | * | 11/1958 | Ensign | 292/DIG. 46 X |
| 2,983,000 | * | 5/1961 | Metzger | 70/97 |
| 3,019,043 | | 1/1962 | Woodworth et al. . | |
| 3,025,693 | * | 3/1962 | Braginetz | 292/DIG. 46 X |
| 3,040,555 | | 6/1962 | Wartian . | |
| 3,041,097 | | 6/1962 | Eads . | |
| 3,105,711 | | 10/1963 | Woodworth et al. . | |
| 3,174,783 | * | 3/1965 | Russell | 292/DIG. 46 X |
| 3,177,687 | * | 4/1965 | Tucker | 70/97 |
| 3,212,803 | | 10/1965 | Russell et al. . | |

(List continued on next page.)

FOREIGN PATENT DOCUMENTS

| | | | | |
|---|---|---|---|---|
| 25555 | * | 9/1906 | (AT) | 70/98 |
| 554012 | * | 3/1958 | (CA) | 292/DIG. 46 |

(List continued on next page.)

*Primary Examiner*—Lloyd A. Gall
(74) *Attorney, Agent, or Firm*—Hovey, Williams, Timmons & Collins

(57) ABSTRACT

A lock mechanisms for a fenestration assembly, such as a sliding door, includes a strike element preferably coupled with the door frame and a catch assembly preferably coupled with the fenestration member slidably supported within the frame. The catch assembly includes a catch having structure defining an element receiving slot. The catch is mounted for shifting among a plurality of positions including an engaged position in which the element is received within the slot and retained therein by the catch when the fenestration member is in a closed position, a disengaged position in which the element is disengaged by the catch when the fenestration member is shifted out of the closed position, and an intermediate position in which the element is received within the slot and the catch is positioned between the engaged and disengaged positions. The catch assembly further includes locking structure for shifting the catch from the intermediate position to the engaged position, and thereby shifting the fenestration member to the closed position, and for locking the catch in the engaged position. The lock mechanism may also be provided with structure for blocking movement of the strike element out of the element receiving slot defined in the catch, when the catch is in the engaged position so as to reduce the risk of intrusion through the fenestration assembly.

44 Claims, 3 Drawing Sheets

U.S. PATENT DOCUMENTS

| | | | | |
|---|---|---|---|---|
| 3,334,934 | * | 8/1967 | Sandor | 292/216 |
| 3,402,578 | * | 9/1968 | Atkinson | 292/199 X |
| 3,596,954 | | 8/1971 | Hull et al. | 292/128 |
| 3,667,791 | * | 6/1972 | Kazaoka et al. | 292/216 |
| 4,054,309 | * | 10/1977 | Borlinghaus | 292/216 |
| 4,273,368 | | 6/1981 | Tanaka | 292/53 |
| 4,563,885 | * | 1/1986 | Madden | 70/97 |
| 4,643,005 | | 2/1987 | Logas | 70/95 |
| 4,973,091 | | 11/1990 | Paulson et al. | 292/51 |
| 5,526,659 | * | 6/1996 | Takimoto | 292/DIG. 46 X |
| 5,553,351 | * | 9/1996 | Starks | 292/210 X |
| 5,595,409 | * | 1/1997 | Fier et al. | 292/DIG. 46 X |

FOREIGN PATENT DOCUMENTS

| | | | | |
|---|---|---|---|---|
| 7546 | * | of 1912 | (GB) | 70/97 |
| 231872 | * | 6/1925 | (GB) | 70/97 |

* cited by examiner

LOCKING MECHANISM FOR SLIDING GLASS DOORS

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates generally to fenestration products, such as sliding glass patio doors. More particularly, the present invention concerns an improved lock mechanism for a fenestration assembly, wherein the mechanism is configured for locking the assembly in a closed position even though the assembly may be slightly ajar.

2. Description of the Prior Art

In many instances, unlawful intrusion into a home or building is gained through a standard fenestration product, such as a sliding door. Accordingly, it is very important that the door include a lock mechanism for securely locking the product in a closed position. It is also important that the lock mechanism provides security without sacrificing durability, practicality, simplicity and economic feasibility. Unfortunately, conventional lock mechanism designs have failed to meet these criteria.

For example, traditional lock mechanisms are capable of locking the door only when the door is closed (i.e., when the door or window is in a closed position). However, it is often difficult to completely close the door. For example, the door frame may be provided with weather stripping which inhibits closing of the door unless the user forcibly slams the door shut. Accordingly, the door will often be left slightly ajar because the user has not exerted enough force to compress the weather stripping. Additionally, fenestration products are often left slightly ajar because the product may appear to be closed even though it is not. Particularly, sliding doors are often received within a slot defined in an upright jamb, and consequently, the door may appear shut even though it is sufficiently ajar to prevent locking.

In any case, the door must often be reclosed before it can be locked by the conventional lock mechanism. It has been determined that some lock mechanisms may be actuated when the door is slightly ajar, but the lock mechanism is not completely engaged so that the user is misled to believe that the door is locked. The user must, therefore, pull the door in the opening direction to ensure it has been locked. Of course, this places untoward wear and load on the lock mechanism. It has also been determined that some lock mechanisms have a tendency to become damaged when the user attempts to actuate the mechanism with the door slightly ajar.

Another common problem with traditional lock mechanisms relates particularly to sliding doors and windows having a fenestration member slidably mounted along a roller track of the door or window frame. The standard lock mechanism for such a fenestration assembly includes a stationary strike secured to the frame and a hook-shaped catch carried on the slidable fenestration member for wrapping partially around the strike when the assembly is closed. Unlawful access through the locked fenestration assembly is achieved simply by dislodging the fenestration member from the roller track so that the strike is released from the catch.

SUMMARY OF THE INVENTION

Responsive to these problems, the present invention concerns an improved lock mechanism for locking a fenestration assembly even when the fenestration member has been left slightly ajar. The inventive lock mechanism comprises a strike element and a catch assembly, one of which may be coupled with the frame and the other coupled with the fenestration member. Particularly, the catch assembly includes a catch having structure defining an element receiving slot, and structure for shiftably mounting the catch for shifting among a plurality of positions including an engaged position in which the element is received within the slot and retained therein by the catch when the fenestration member is in its closed position, a disengaged position in which the element is disengaged by the catch when the fenestration member is shifted away from the closed position, and an intermediate position in which the element is received within the slot and the catch is positioned between the engaged and disengaged positions. The catch assembly further includes locking structure for shifting the catch from the intermediate position to the engaged position, and thereby shifting the fenestration member to the closed position, and for locking the catch in the engaged position.

The locking structure preferably includes a component shiftable toward and away from a locked position in which the catch is prevented from shifting away from the engaged position. The catch is provided with safety structure for preventing the locking component from shifting toward the locked position when the catch is in its disengaged position. Since the disengaged position of the catch corresponds to the open condition of the fenestration assembly, the safety structure prevents the lock mechanism from being locked when the assembly is open. This minimizes the risk of "lock-out" situations. That is, the user is less likely to be inadvertently locked outside the fenestration assembly because the lock mechanism cannot be actuated when the assembly is open.

The present invention is also concerned with a lock mechanism that minimizes the risk of intrusion through the fenestration assembly. The lock mechanism may further include structure for blocking the movement of the element through the open end of the slot when the catch is in its engaged position. With the catch locked in its engaged position, the strike element cannot be released from the catch simply by shifting it through the open end of the slot. This construction would consequently prevent intrusion through a sliding door by dislodging the fenestration member from the roller track of the frame, as described above.

BRIEF DESCRIPTION OF THE DRAWINGS

A preferred embodiment of the invention is described in detail below with reference to the attached drawing figures, wherein.

DETAILED DESCRIPTION OF THE PREFERRED EMBODIMENT

Figure 1:
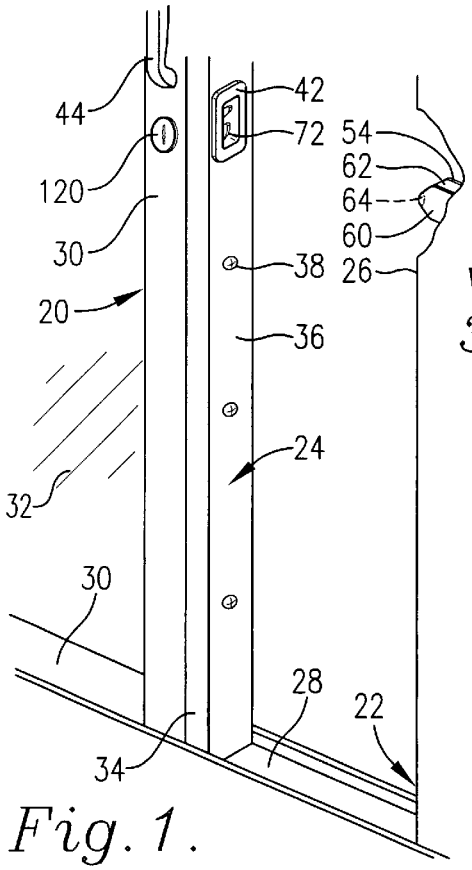
FIG. 1 is a perspective view of a sliding door having a lock mechanism constructed in accordance with the present invention, illustrating the door in an open position.

Turning initially to FIG. 1, a sliding door 20 includes a door frame 22 and a fenestration member 24 slidably mounted within the frame 22. The door frame 22 includes a pair of spaced upright jambs 26 (only one jamb being shown in FIG. 1) and a roller track 28 extending therebetween. In the usual manner, the fenestration member 24 is slidably mounted within the roller track 28 for horizontal movement between the jambs 26. The fenestration member 24 is shown in an open position in FIG. 1, but is slidable to a closed position in which the member lies in juxtaposition with the illustrated jamb 26 (see FIG. 5).

Figure 3:
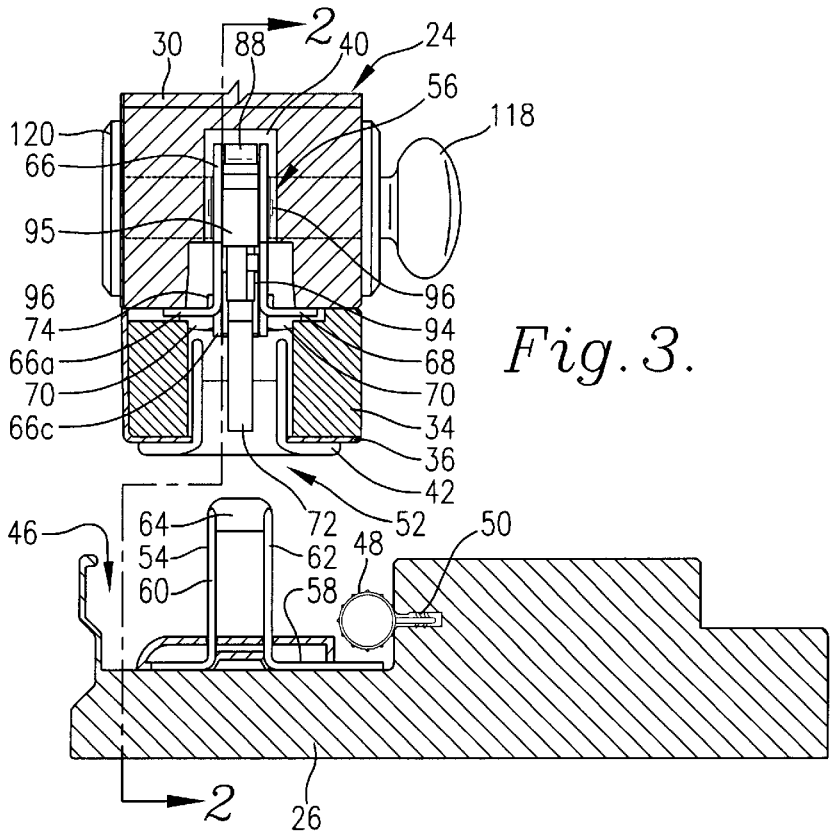
FIG. 3 is an enlarged fragmentary horizontal sectional view of the lock mechanism taken along 3—3 in FIG. 2, particularly illustrating the configuration of the door jamb and the interior thumbturn and exterior key-operated lock cylinder for affording manual operation of the lock mechanism.
Figure 2:
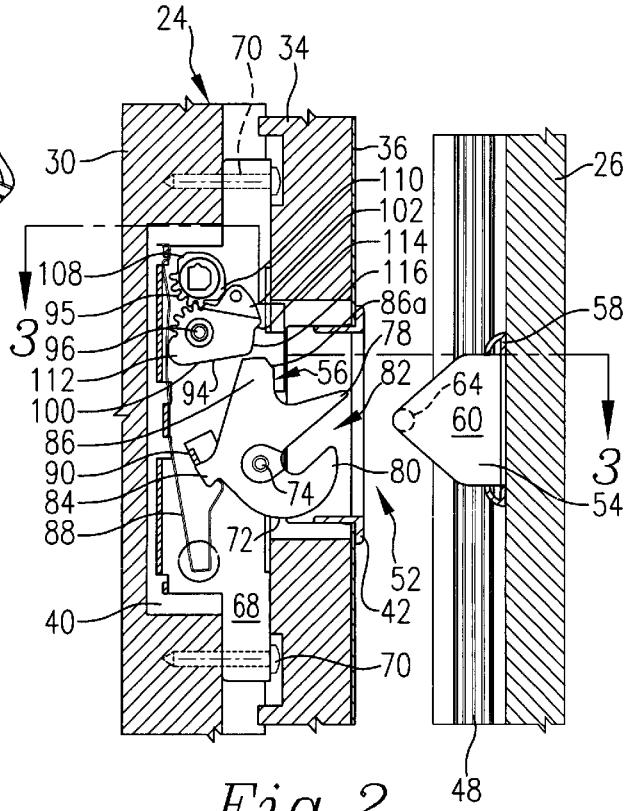
FIG. 2 is an enlarged, fragmentary vertical sectional view of the lock mechanism taken generally along line 2—2 in FIG. 3, with the door open and parts of the mechanism being broken away to illustrate the catch in the disengaged position.

The fenestration member 24 includes a rectangular glass frame 30 carrying a glass pane 32, and a lock housing 34 extending along one side of the glass frame 30. A protective cladding 36 covers the exterior and side face of the lock housing 34, with the lock housing 34 and cladding 36 being secured to the glass frame 30 by screws 38 (see FIG. 1). As shown in FIGS. 2 and 3, the glass frame 30, lock housing 34 and cladding 36 cooperatively define an opening 40 within the fenestration member 24 for purposes which will be described below. A protective jacket 42 is snap-fit within the opening 40 for protecting the cladding 36 around the opening 40 and covering any unsightly edges of the cladding 36. Door handles 44 are provided on the interior and exterior sides of the fenestration member 24 (only the exterior handle being shown in FIG. 1) so that the fenestration member 24 may be manually slid toward and away from its closed position.

As shown in FIG. 3, the illustrated door jamb 26 of the frame 22 is formed of wood and an extruded bar having a longitudinal slot 46 for receiving the fenestration member 24 when the member is in its closed position. Extending the length of the slot 46 is a sealing strip 48 formed of resilient material, such as rubber, with a portion of the strip 48 being fixedly secured within a longitudinal slit 50 of the jamb 26. The strip 48 may have a hollow, generally circular configuration, as shown in FIG. 3, or other appropriate shapes. The sealing strip 48 is compressed when the fenestration member is slid to its closed position (see FIG. 5).

A lock mechanism 52, is configured for locking the member 24 in the closed position even when the member 24 has been left slightly ajar, and is capable of sliding an ajar member 24 shut when the mechanism is actuated to lock the member 24 in the closed position. As shown in FIGS. 2 and 3, the mechanism 52 generally includes a strike 54 mounted to the door jamb 26 within the slot 46 in vertical alignment with the member opening 40, and a catch assembly 56 mounted within the opening 40.

The strike 54 preferably comprises a unitary metal body including a base 58 secured to the jamb 26 by suitable means, such as screws (not shown). Extending outwardly from the base 58 toward the fenestration member 24 are a pair of horizontally spaced plates 60 and 62. As shown in FIG. 3, the plates 60, 62 are spaced relatively close to one another so that the strike 54 may be received within the jacket 42. A substantially cylindrical strike post 64 extends between the plates 60 and 62.

Figure 6:
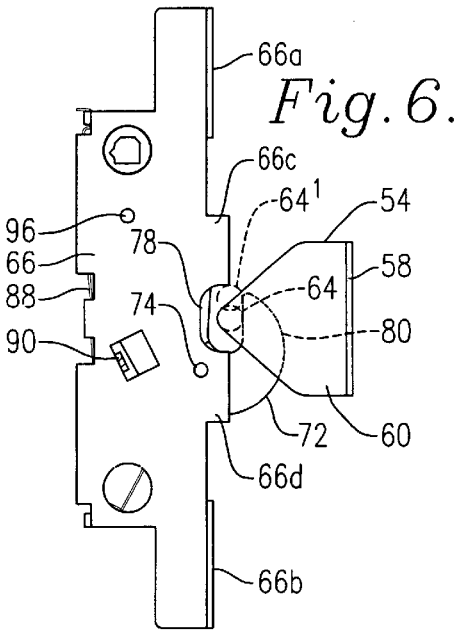
FIG. 6 is a side elevational view of the lock mechanism, with parts being broken away to show the structure for blocking movement of the strike element through the open end of the slot when the catch is in its engaged positioned.

Turning to the catch assembly 56, a pair of generally L-shaped mounting plates 66 and 68 are provided for supporting the various other components of the assembly 56 within the opening 40. The plates 66 and 68 are secured to one another by suitable means and are similarly designed. For the sake of brevity, only the constructional details of the mounting plate 66 will be discussed herein, with the understanding that the plate 68 includes like components and features. As shown in FIGS. 3 and 6, the mounting plate 66 includes a pair of outwardly projecting flanges 66*a* and 66*b*, each of which is fastened to the outer face of the glass frame 30 by a corresponding screw 70 for securing the catch assembly 56 within the opening 40. The mounting plate 66 further includes a pair of vertically spaced tabs 66*c* and 66*d* projecting toward the door jamb 26 for purposes which will be described below.

A generally hook-shaped catch 72 is rotatably mounted between the plates 66 and 68 by a pin 74. The catch 72 comprises a pair of spaced apart jaws 78 and 80 cooperatively defining an open-ended post receiving slot 82, a relatively small projection 84 extending in a direction generally opposite to the relatively longer jaw 78, and an arm 86 projecting generally radially from the pin 74 between the longer jaw 78 and projection 84. The arm 86 has a convex arcuate face 86*a* for purposes which will be described below. A spring 88 retained between the mounting plates 66 and 68 has an end bearing against the projection 84 to yieldably bias the catch 72 in a clockwise direction (when viewing FIG. 2). Rotation of the catch 72 is limited by a stop tab 90 punched from the mounting plate 68. The tab 90 is configured for abuttingly engaging the projection 84 to prevent clockwise rotation of the catch 72 beyond the position shown in FIG. 2.

Figure 4:
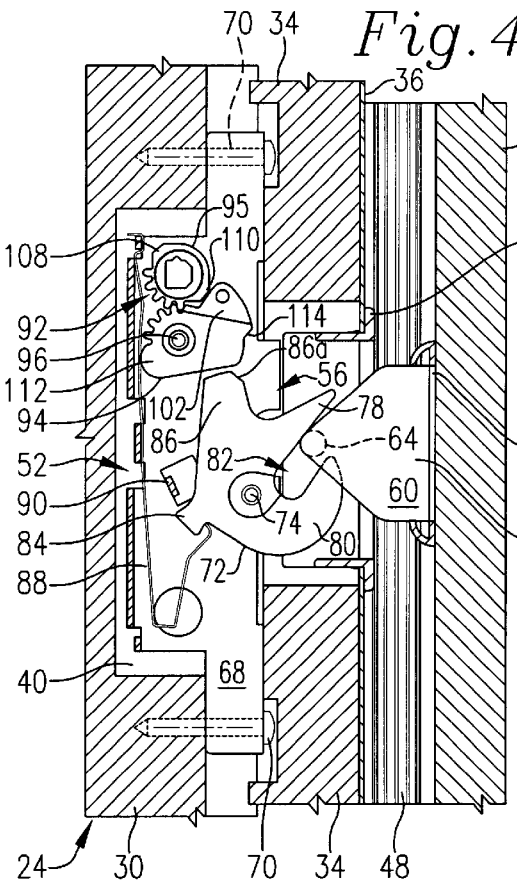
FIG. 4 is a fragmentary vertical sectional view of the lock mechanism similar to FIG. 2, but illustrating the door as it shifts toward the closed position, with the strike engaging the catch to shift the latter toward the engaged position.
Figure 5:
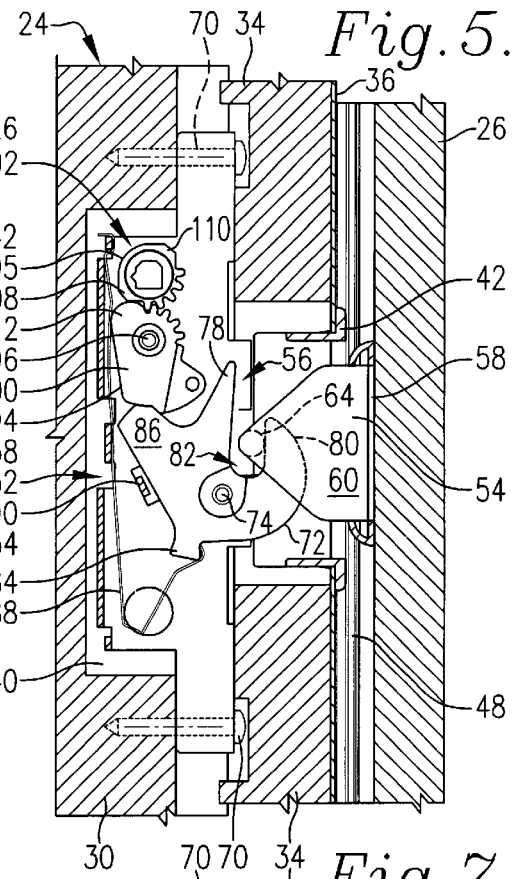
FIG. 5 is a fragmentary vertical sectional view of the lock mechanism similar to FIG. 4, but illustrating the door in a closed position, with the catch being locked in its engaged position by the locking component.

As the door 20 is closed, the strike 54 shifts the catch 72 against the bias of spring 88 toward an engaged position corresponding to the closed position of the fenestration member 24 (see FIG. 5). Particularly, the longer jaw 78 defines a cam surface that is engaged by the strike post 64 as the fenestration member 24 slides toward its closed position (see FIG. 4). During closing movement of the fenestration member 24 (in the rightward direction of FIG. 4), the jaw 78 slides along the strike post 64 to rotate the catch 72 in a counterclockwise direction. Such rotation of the catch 72 causes the jaw 80 to wrap around the strike post 64 so that the post is progressively captured within the slot 82. Once the sliding door 20 has been completely shut, the strike 54 has shifted the catch 72 to the engaged position, wherein the post 64 is received within the slot 82 (see FIG. 5). The stop tab 90 is configured for abuttingly engaging the catch 72 along the face extending between the projection 84 and the arm 86 for preventing over-rotation of the catch 72 beyond its engaged position. Although the strike post 64 is retained within the slot 82 when the catch 72 is in its engaged position, the fenestration member 24 is freely shiftable out of the closed position. That is, the catch 72 alone does not serve to lock the fenestration member 24 in the closed position.

Accordingly, the catch assembly 56 includes locking structure 92 for selectively locking the catch 72 in its engaged position and includes a cam 94 rotatably mounted between the mounting plates 66 and 68 by a pin 96, and a rotatable gear 95 for controlling rotational movement of the cam 94. The cam 94 comprises a latching portion 100 configured to engage the arm 86 of the catch 72 and a relatively thinner connecting portion 102 for connection to the operating linkage of a multiple point locking system.

The latching portion 100 of the locking cam 94 and the gear 95 have intermeshing teeth for transferring rotational movement of the gear 95 to the cam 94, and vice versa. The gear 95 includes a pair of diametrically opposed stops 108 and 110 situated on either end of the series of teeth for limiting relative rotational movement of the cam 94. The stop 108 is configured to engage the latching portion 100 for preventing clockwise rotation of the cam 94 beyond the locked position shown in FIG. 5. On the other hand, the stop 110 is configured to engage the connecting portion 102 for preventing counterclockwise rotation of the cam 94 beyond the unlocked position shown in FIG. 2. Thus, the gear 95 limits rotational movement of the cam 94 between the locked and unlocked positions.

The latching portion 100 further includes a rounded knob 112 adjacent its series of teeth. The spring 88 engages the knob 112 for providing an over-center bias on the cam 94. Particularly, the spring 88 yieldably biases the cam 94 in opposite directions when the cam 94 is located on opposite sides of a center position (corresponding generally to the position shown in FIG. 8). Accordingly, when the cam 94 is located off center toward the unlocked position, the spring 88 yieldably biases the cam 94 in a counterclockwise direction toward the unlocked position. Similarly, when the cam 94 is located off center toward the locked position, the spring 88 yieldably biases the cam 94 in a clockwise direction toward the locked position. As previously mentioned, the gear stops 108 and 100 prevent rotation of the cam 94 beyond the locked and unlocked positions, respectively.

The latching portion 100 is provided with a shoulder 114 configured to abuttingly engage the arm 86 of the catch 72 when the catch is in its engaged position and the cam 94 is in its locked position, as shown in FIG. 5. Particularly, the shoulder 114 extends along the right side of the arm 86 to prevent clockwise movement of the cam 94 out of its engaged position. A concave arcuate face 116 adjacent the shoulder 114 mates with the arcuate face 86*a* of the arm 86 when the door 20 is closed and locked. It will be appreciated that the arcuate faces 86*a* and 116 are arranged in a manner to prevent the catch 72 from rotating the cam 94 out of its locked position. That is, forces urging the catch 72 in the clockwise direction out of the engaged position (e.g., the spring bias exerted by the spring 88 against the catch 72 or the force of the strike post 64 exerted against the jaw 80 when the fenestration member 24 is pulled in an opening direction) are unable to unlock the mechanism 52. As shown in FIG. 5, such forces are transferred from the catch 72 to the cam 94 across the mating faces 86*a* and 116 in a direction toward the rotational axis of the cam 94 (i.e., pin 96) and therefore do not urge the cam 94 in a counterclockwise direction out of the locked position.

Accordingly, with the fenestration member 24 in the closed position and the catch 72 in the corresponding engaged position, the locking cam 94 may be rotated to the locked position to prevent opening of the sliding door 20. As indicated above, the fenestration member 24 may be pulled freely from the closed position when the locking cam 94 is in its unlocked position. The gear 95 is coupled with an interior thumbturn 118 and an optional exterior key-operated lock cylinder 120 (see FIG. 3) for manually controlling movement of the locking cam 94 between its locked and unlocked positions. Although not shown in detail, it will be appreciated that the thumbturn 118 and exterior lock cylinder 120 are aligned with the rotational axis of the gear 95 and are operably interconnected by the gear 95 in the usual manner. Accordingly, shifting of the locking cam 94 between the locked and unlocked positions is controlled by the thumbturn 118 when the user is located inside the door and controlled by the key lock 120 when the user is located outside the door. The principles of the present invention, however, are equally applicable to a lock mechanism 52 having an automatic or remote controlled device coupled with the reversing gear 95 for controlling rotation of the locking cam 94 between its locked and unlocked positions. Further, it is entirely within the ambit of the present invention to replace the reversing gear 95 with linkage or other structure for operably coupling the locking cam 94 with the thumbturn 118 or lock cylinder 120.

As shown in FIG. 6, when the fenestration member 24 is closed, the strike post 64 is received between the vertically spaced tabs 66*c* and 66*d* of the mounting plates 66 and 68 (only the tabs 66*c* and 66*d* of the mounting plate 66 being shown in FIG. 6). The tabs 66*c* and 66*d* cooperate with the catch 72 to define a substantially enclosed space within which the strike post 64 is received when the fenestration member 24 is in its closed position and the catch 72 is consequently in its engaged position. Further, the upper tabs 66*c* of the mounting plates 66 and 68 extend substantially across the open end of the slot 82 for blocking movement of the strike post 64 through the open end of the slot 82 when the catch 72 is in its engaged position. Although a relatively small gap is defined between the outer edge of the upper tab 66*c* and the tip of the jaw 80, the gap is narrower than the diameter of the strike post 64 so that the post 64 cannot be shifted therethrough, as illustrated by the schematic depiction of the post referenced by the symbol 64'. If desired, the tab 66*c* may be configured to extend entirely across the open end of the slot 82. Further, the means for blocking movement of the strike post 64 through the open end of the slot 82, when the catch 72 is in the engaged position, may comprise other suitable structure such as a bolt or rigid post projecting from the fenestration member 24. It will be appreciated that the lock housing 34, cladding 36 and protective jacket 42 similarly restricts movement of the strike 54 relative to the fenestration member 24 when the member 24 is closed and locked.

In any case, the tabs 66*c* and 66*d* minimize the risk of intrusion through the sliding door traditionally achieved by dislodging the fenestration member 24 from the roller track 28. It will be appreciated that such dislodgement of the fenestration member 24 requires vertical shifting of the member 24 relative to the door jamb 26 so that the strike post 64 is released from the catch 72. With the illustrated embodiment, vertical shifting of the fenestration member 24 is limited by the enclosed space cooperatively defined by the catch 72 and tabs 66*c*,66*d*, so that dislodgement of the member is prevented altogether. However, if for any reason the intruder is able to dislodge the member 24 from the roller track 28, the strike post 64 remains captured between the catch 72 and the tabs 66*c*,66*d* so as to further inhibit entry through the sliding door 20.

As perhaps best shown in FIGS. 2 and 4, the catch 72 is configured to prevent "lock-out" situations traditionally caused by the user inadvertently actuating the lock mechanism while the sliding door 20 is open. In other words, the lock mechanism 52 includes a safety for preventing the locking cam 94 from being rotated to the locked position when the door is open. Particularly, with the door 20 open, the catch 72 is normally in the disengaged position and the locking cam 94 is normally in the unlocked position, with the arm 86 projecting upwardly toward the cam 94 (see FIG. 2). Accordingly, the locking cam 94 is able to rotate only a very small amount in the clockwise direction toward the locked position before the generally flat face thereof abuttingly engages the arm 86. It is possible for the user to lock the catch 72 in the engaged position with the door 20 open by manually shifting the catch 72 to the engaged position and turning the thumbturn 118 or lock cylinder 120 to rotate the locking cam 94 to the locked position. If the fenestration member 24 is subsequently slid toward the closed position, the outside curved face of the catch jaw 80 engages the strike post 64 to prevent the door 20 from completely closing. Should this sequence of events occur, the stop tab 90 engages the catch 72 to prevent the strike post 64 from over-rotating the catch 72.

Figure 7:
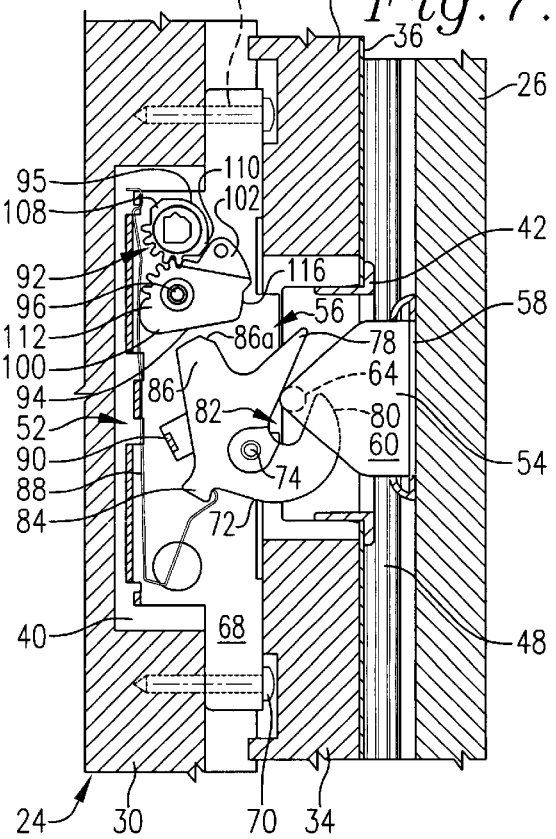
FIG. 7 is a fragmentary vertical sectional view of the lock mechanism similar to FIG. 2, but illustrating the door slightly ajar with the catch in the intermediate position.

As shown in FIG. 7, the catch 72 continues to prevent rotation of the locking cam 94 toward the locked position until the catch 72 reaches an intermediate position, in which the fenestration member 24 is spaced slightly away from its closed position yet the strike post 64 is received within the catch slot 82. Accordingly, rotation of the locking cam 94 toward its locked position is blocked by the catch arm 86 even when the fenestration member 24 has just been received within the slot 46 of the door jamb 26, with the catch 72 shifted slightly away from the disengaged position by the strike post 64, as shown in FIG. 4. It will be appreciated that the relationship between the intermediate position of the catch 72 and the location of the fenestration member 24 when the catch 72 is in its intermediate position may be varied as desired. For example, the catch assembly 56 may be configured so that the locking cam 94 may rotate to the locked position when the fenestration member 24 is in the position shown in FIG. 4 (i.e., the catch 72 is disposed in the intermediate position when the fenestration member 24 has just been received within the slot 46 of the door jamb 26).

Figures 8, 9, 10:
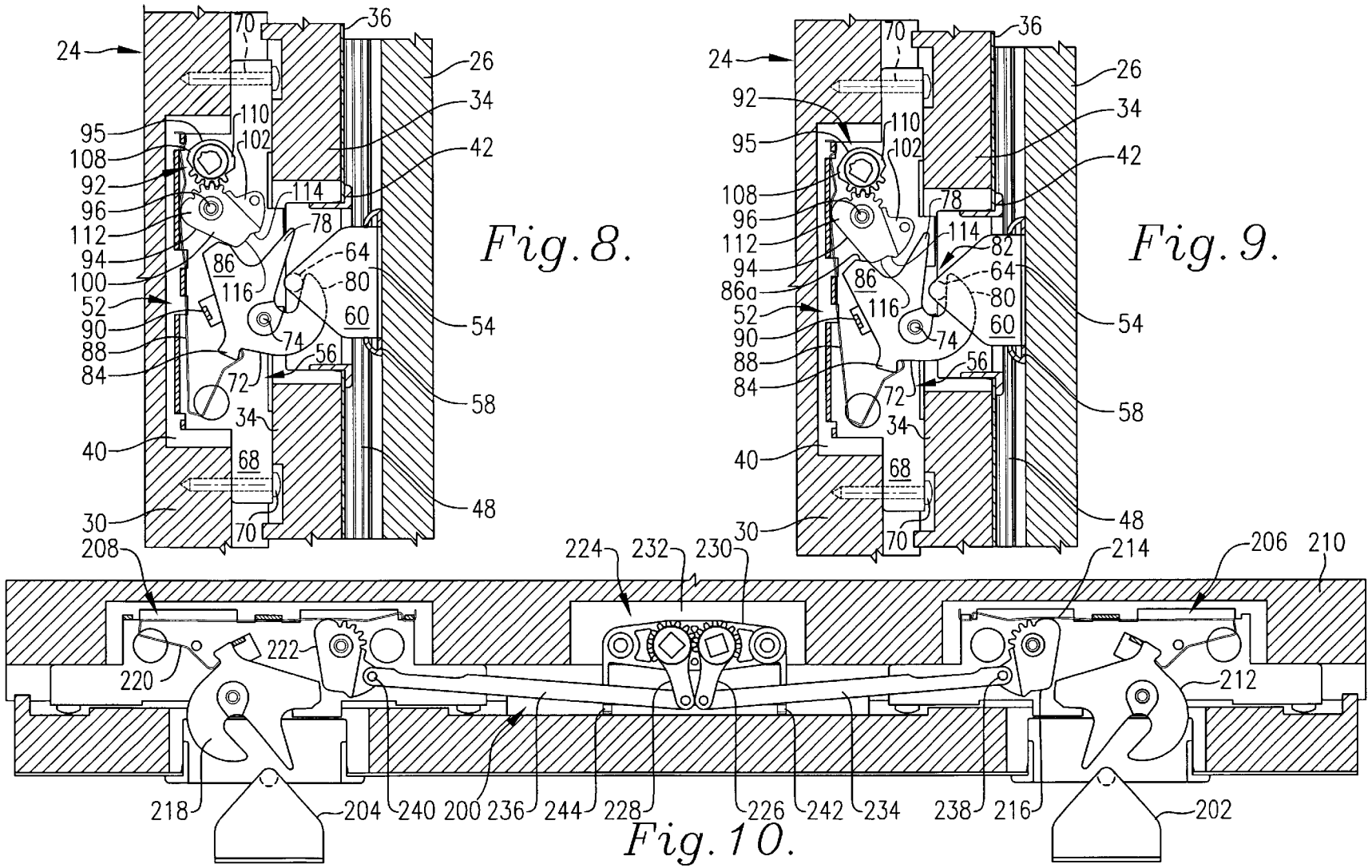
FIG. 8 is a fragmentary vertical sectional view of the lock mechanism similar to FIG. 7, but illustrating the locking component as it shifts toward the locked position and thereby shifts the catch toward the engaged position and draws the door shut.
FIG. 9 is a fragmentary vertical sectional view of the lock mechanism similar to FIG. 8, but illustrating the locking component just before it reaches the locked position, with the catch almost in its engaged position.
FIG. 10 is a fragmentary vertical sectional view of an alternative, multiple point lock mechanism constructed in accordance with the principles of the present invention, wherein the mechanism includes a pair of catches for engagement with a pair of strike elements and an operating assembly for simultaneously locking the catches in the engaged position.

Nonetheless, once the catch 72 is disposed in the intermediate position, the locking cam 94 may be rotated in the clockwise direction toward the locked position. As shown in FIG. 8, such rotation of the locking cam 94 causes the latching portion 100 of the cam 94 to engage the catch arm 86. Further rotation of the cam 94 toward the locked position results in rotation of the catch 72 in the counterclockwise direction toward its engaged position against the bias of spring 88. As shown in FIG. 9, the arcuate faces 86*a* and 116 of the catch arm 86 and latching position 116, respectively, will be placed in a flush mating relationship just as before the catch 72 is rotated to the engaged position. Rotation of the locking cam 94 beyond the position shown in FIG. 9 will place the cam 94 in the locked position and the catch 72 in the engaged position, as shown in FIG. 5. This action is assisted by the spring bias exerted against knob 112. Thus, the locking structure 92 is configured to shift the catch 72 from the intermediate position to the engaged position. Further, with the catch 72 in its engaged position and the strike post 64 received within the slot 82, actuation of the locking structure 92 causes the fenestration member 24 to be drawn to the closed position. Particularly, the jaw 80 slides about the strike post 64 when the catch 72 is rotated toward the engaged position by the locking cam 94. Accordingly, the catch 72 pulls on the stationary strike post 64 as the locking cam 94 rotates the catch 72 to the engaged position. Of course, the locking cam 94 is also operable to rotate the catch 72 toward the engaged position when the catch 72 is located anywhere between the intermediate and engaged positions. Accordingly, with the fenestration member 24 located nearer the closed position than shown in FIG. 7, actuation of the locking structure 92 will likewise slide the fenestration member 24 to the closed position.

In this respect, even with the fenestration member 24 spaced slightly from its closed position, as shown in FIG. 7, the locking structure 92 may be actuated to lock the member 24 in its closed position. For example, if the user has left the door 20 slightly ajar with the catch 72 in the intermediate position and the strike post 64 received within the slot 82, the locking cam 94 may be rotated toward its locked position to rotate the catch 72 to its engaged position and thereby draw the fenestration member 24 to the closed position. This configuration minimizes the effort and degree of attention required to lock the fenestration member 24 in the closed position—the user simply needs to place the member 24 near its closed position and turn the thumbturn 118 or lock cylinder 120.

The use and operation of the sliding door 20 should be apparent from the foregoing description. Therefore, it is sufficient to explain that with the locking cam 94 in the unlocked position, the user may grasp the door handle 44 and freely pull the fenestration member toward and away from its closed position. When it is desired to lock the fenestration member 24 in the closed position, the user simply slides the member 24 to the closed position and actuates the locking structure 92 by rotating the thumbturn 118 or lock cylinder 120 to place the locking cam 94 in the locked position. If for any reason the fenestration member 24 is spaced slightly from the closed position (with the catch 72 in the engaged position) when the locking structure 92 is actuated, the locking cam 94 will rotate the catch 72 to the engaged position and thereby slide the member 24 to the closed position.

The principles of the present invention are equally applicable to a multiple point lock mechanism, generally referenced by the numeral 200 in FIG. 10. The multiple point lock mechanism 200 includes a pair of vertically spaced strikes 202 and 204 supported on the door jamb (not shown) and a pair of vertically spaced catch assemblies 206 and 208 mounted on the fenestration member 210 in vertical alignment with the strikes 202 and 204, respectively. The catch assemblies 206 and 208 are similar in construction to the single point lock mechanism 52 shown in FIGS. 1–9 and therefore function in a similar manner. Accordingly, the upper assembly 206 includes, among other things, a rotatable catch 212 yieldably biased to the disengaged position by a spring 214, and a rotatable locking cam 216 for shifting the catch 212 from the intermediate position to the engaged position and locking the catch in the engaged position. The lower assembly 208 similarly includes a catch 218, a spring 220 and a locking cam 222.

However, the multiple point lock mechanism 200 includes a common operating assembly 224 for controlling rotation of the locking cams 216 and 222. The operating assembly 224 includes a pair of crank members 226 and 228 rotatably mounted to a bracket 230 secured within a central opening 232 of the fenestration member 210. The crank members 226 and 228 having intermeshing teeth for translating rotational movement of one member to the other. A pair of tie bars 234 and 236 are pivotally connected between the crank members 226 and 228 and the locking cams 216 and 222, respectively, for transferring movement of the crank members to the locking cams. As indicated above, the locking cams 216 and 222 include respective posts 238 and 240 for pivotal connection to the respective tie bars 234 and 236. The bracket 230 includes a pair of guide posts 242 and 244 for limiting movement of the tie bars 234 and 236 along a generally linear path. One of the crank members 226 or 228 is coupled with a thumbturn (not shown) and a key-operated lock cylinder (also not shown) so that actuation of the lock mechanism 200 is manually controlled.

Accordingly, when the lower crank member 228 is rotated in the clockwise direction, the remote ends of the crank members 226 and 228 swing away from one another causing the tie bars 234 and 236 to simultaneously rotate the locking cams 216 and 222 toward their respective locked positions. On the other hand, when the lower crank member 228 is rotated in the counterclockwise direction, the crank members 226 and 228 are swung toward one another causing the tie bars 234 and 236 to simultaneously rotate the locking cams toward the unlocked position.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the principles of the present invention are equally applicable to a lock mechanism with the catch and locking cam arranged or configured in a different manner, such as a linearly shiftable locking component for shifting the catch from its intermediate position to its engaged position and for locking the catch in its engaged position. Alternatively, the locking structure may include separate components for shifting the catch from its intermediate position to its locked position and for locking the catch in its engaged position, both of which are controlled by a common operating assembly of the locking structure. It is also entirely within the ambit of the present invention to mount the strike on the fenestration member and the catch assembly on the stationary door jamb, if so desired.

The inventor hereby states his intent to rely on the doctrine of equivalents to determine and assess the reasonably fair scope of the present invention as pertains to any apparatus not materially departing from but outside the literal scope of the invention as set forth in the following claims:

1. A lock mechanism for a fenestration product having a frame member and a fenestration member shiftably supported by the frame member for movement into and out of a closed position, said lock mechanism comprising:

a strike element; and a catch assembly, said catch assembly and said strike clement being mountable to respective ones of the members so that there is relative shifting movement between said catch assembly and said strike element when the fenestration member is shifted into and out of the closed position, said catch assembly includings catch having structure defining an element receiving slot, a mounting assembly configured to shiftably mount said catch for shifting among a plurality of positions including an engaged position in which said element is received within said slot and retained therein by said catch, a disengaged position in which said element is disengaged by said catch, and an intermediate position in which said element is received within said slot and said catch is positioned between said engaged and disengaged positions, and a locking assembly operable to shift said catch from said intermediate position to said engaged position, and thereby cause said relative shifting movement in a direction corresponding to shifting of the fenestration member to the closed position, and lock said catch in said engaged position such that said locking assembly prevents said catch from shifting out of said engaged position, said locking assembly including a locking component shiftably supported for selective movement between a locked position in which the locking component engages and thereby prevents the catch from shifting away from the engaged position and an unlocked position in which the locking component is disengaged from the catch and thereby permits the catch to shift freely toward and away from the engaged position, said catch being yieldably biased into the disengaged position.

2. A lock mechanism as claimed in claim 1, said strike element including a post configured for reception within said slot.

3. A lock mechanism as claimed in claim 1, said mounting assembly including a pin for rotatably mounting said catch for rotational movement among said engaged, intermediate and disengaged positions.

4. A lock mechanism as claimed in claim 1, said catch presenting a hook shape with a curved portion adjacent one end thereof.

5. A lock mechanism as claimed in claim 4, said slot extending inwardly from said one end.

6. A lock mechanism as claimed in claim 5, said catch assembly including a blocking mechanism configured to block movement of said element through said one end when said catch is in said engaged position.

7. A lock mechanism as claimed in claim 1, said slot having an open end, said catch assembly including a blocking mechanism configured to block movement of said element through said open end when said catch is in said engaged position.

8. A lock mechanism as claimed in claim 7, said blocking mechanism including at least one tab extending substantially across said open end of said slot when said catch is in said engaged position.

9. A lock mechanism as claimed in claim 1, said catch assembly including biasing structure operable to yieldably bias said catch toward said disengaged position.

10. A lock mechanism as claimed in claim 9, said catch including a cam surface configured for interengagement with said strike element, such that said element is operable to shift said catch away from said disengaged position against said biasing structure when said catch assembly and said element move relatively in a direction toward one another.

11. A lock mechanism as claimed in claim 1, said locking component being configured to engage said catch in said intermediate position for shifting said catch to said engaged position as said component shifts toward said locked position.

12. A lock mechanism as claimed in claim 11, said locking assembly including a support assembly operable to shiftably support said component, said support assembly including a pin for rotatably supporting said locking component for rotational movement between said locked and unlocked positions.

13. A lock mechanism as claimed in claim 12, said mounting assembly including a pin for rotatably mounting said catch for rotational movement among said engaged, intermediate and disengaged positions, with said component and said catch rotating in opposite directions as said component shifts said catch toward said engaged position.

14. A lock mechanism as claimed in claim 13;

said locking component being rotatable to a center position located between said locked and unlocked positions, said catch assembly including over-center biasing structure operable to yieldably bias said component toward said locked position when said component is located between said center and locked positions, and for yieldably biasing said component toward said unlocked position when said component is located between said center and unlocked positions.

15. A lock mechanism as claimed in claim 1, said catch assembly including a safety operable to prevent said component from shifting toward said locked position when said catch is in said disengaged position.

16. A lock mechanism as claimed in claim 15, said safety further preventing said component from shifting to said locked position when said catch is located between said intermediate and disengaged positions.

17. A lock mechanism as claimed in claim 16, said mounting assembly including a pin for rotatably mounting said catch for rotational movement among said engaged, intermediate and disengaged positions, said safety being a part of said catch and including an arm projecting generally radially from said pin, said locking component abuttingly engaging said arm to exert a force against said arm in a direction toward said pin as said component is shifted toward said locked position, when said catch is located between said intermediate and disengaged positions and in said disengaged position.

18. A lock mechanism as claimed in claim 1, said locking assembly including an operating assembly operable to manually control shifting of said locking component between said locked and unlocked positions.

19. A lock mechanism as claimed in claim 18, said locking component including a series of teeth, said operating assembly including a rotatable gear having a plurality of circumferentially spaced teeth intermeshing with said teeth on said locking component, such that rotation of said gear shifts said component.

20. A lock mechanism as claimed in claim 19, said gear including stops for preventing shifting of said component beyond said locked and unlocked positions.

21. A lock mechanism as claimed in claim 1, said slot having an open end, said catch assembly including a blocking mechanism configured to block movement of said element through said open end when said catch is in said engaged position, said locking assembly including a support assembly operable to shiftably support said component for shifting between a locked position and an unlocked position, and an operating assembly operable to manually control shifting of said locking component between said locked and unlocked positions, and said catch assembly including a safety operable to prevent said component from shifting to said locked position when said catch is in said disengaged position.

22. A fenestration assembly comprising:

a frame member;

a fenestration member slidably supported within said frame member for movement toward and away from a closed position; and a lock mechanism for selectively locking said fenestration member in said closed position, said mechanism including strike element coupled with one of said members, and a catch assembly coupled with the other of said members, said assembly including a catch having structure defining an element receiving slot, a mounting assembly configured to shiftably mount said catch for shifting among a plurality of positions including an engaged position in which said element is received within said slot and retained therein by said catch when said fenestration member is in said closed position, a disengaged position in which said element is disengaged by said catch when said fenestration member is shifted away from said closed position, and an intermediate position in which said element is received within said slot and said catch is positioned between said engaged and disengaged positions, and a locking assembly operable to shift said catch from said intermediate position to said engaged position, and thereby shift said fenestration member to said closed position, and lock said catch in said engaged position such that said locking assembly prevents said catch from shifting out of said engaged position, said locking assembly including a locking component shiftably supported for selective movement between a locked position in which the locking component engages and thereby prevents the catch from shifting away from the engaged position and an unlocked position in which the locking component is disengaged from the catch and thereby permits the catch to shift freely toward and away from the engaged position, said catch being yieldably biased into the disengaged position.

23. A fenestration assembly as claimed in claim 22, said frame member including an upright jamb which lies in juxtaposition with said fenestration member when in said closed position.

24. A fenestration assembly as claimed in claim 22, said fenestration member including a window pane.

25. A fenestration assembly as claimed in claim 22, said strike element including a post configured for reception within said slot.

26. A fenestration assembly as claimed in claim 22, said mounting assembly including a pin for rotatably mounting said catch for rotational movement among said engaged, intermediate and disengaged positions.

27. A fenestration assembly as claimed in claim 22, said catch presenting a hook shape with a curved portion adjacent one end thereof.

28. A fenestration assembly as claimed in claim 27, said slot extending inwardly from said one end.

29. A fenestration assembly as claimed in claim 28, said catch assembly including a blocking mechanism configured to block movement of said element through said one end when said catch is in said engaged position.

30. A fenestration assembly as claimed in claim 22, said slot having an open end, said catch assembly including a blocking mechanism configured to block movement of said element through said open end when said catch is in said engaged position.

31. A fenestration assembly as claimed in claim 30, said blocking mechanism including at least one tab extending substantially across said open end of said slot when said catch is in said engaged position.

32. A fenestration assembly as claimed in claim 22, said catch assembly including biasing structure operable to yieldably bias said catch toward said disengaged position.

33. A fenestration assembly as claimed in claim 32, said catch including a cam surface configured for interengagement with said strike element, such that said element is operable to shift said catch away from said disengaged position against said biasing structure when said fenestration member is moved toward said closed position.

34. A fenestration assembly as claimed in claim 22, said locking component being configured to engage said catch in said intermediate position for shifting said catch to said engaged position as said component shifts toward said locked position.

35. A fenestration assembly as claimed in claim 34, said locking assembly including a support assembly operable to shiftably support said component, said support assembly including a pin for rotatably supporting said locking component for rotational movement between said locked and unlocked positions.

36. A fenestration assembly as claimed in claim 35, said mounting assembly including a pin for rotatably mounting said catch for rotational movement among said engaged, intermediate and disengaged positions, with said component and said catch rotating in opposite directions as said component shifts said catch toward said engaged position.

37. A fenestration assembly as claimed in claim 36, said locking component being rotatable to a center position located between said locked and unlocked positions, said catch assembly including over-center biasing structure operable to yieldably bias said component toward said locked position when said component is located between said center and locked positions, and for yieldably biasing said component toward said unlocked position when said component is located between said center and unlocked positions.

38. A fenestration assembly as claimed in claim 22, said catch assembly including a safety operable to prevent said component from shifting toward said locked position when said catch is in said disengaged position.

39. A fenestration assembly as claimed in claim 38, said safety further preventing said component from shifting to said locked position when said catch is located between said intermediate and disengaged positions.

40. A fenestration assembly as claimed in claim 39, said mounting assembly including a pin for rotatably mounting said catch for rotational movement among said engaged, intermediate and disengaged positions, said safety being a part of said catch and including an arm projecting generally radially from said pin, said locking component abuttingly engaging said arm to exert a force against said arm in a direction toward said pin as said component is shifted toward said locked position, when said catch is located between said intermediate and disengaged positions and in said disengaged position.

41. A fenestration assembly as claimed in claim 22, said locking assembly including an operating assembly operable to manually control shifting of said locking component between said locked and unlocked positions.

42. A fenestration assembly as claimed in claim 41, said locking component including a series of teeth, said operating assembly including a rotatable gear having a plurality of circumferentially spaced teeth intermeshing with said teeth on said locking component, such that rotation of said gear shifts said component.

43. A fenestration assembly as claimed in claim 42, said gear including stops for preventing shifting of said component beyond said locked and unlocked positions.

44. A fenestration assembly as claimed in claim 22, said slot having an open end, said catch assembly including a blocking mechanism configured to block movement of said element through said open end when said catch is in said engaged position, said locking assembly including a support assembly operable to shiftably support said component for shifting between a locked position and an unlocked position, and an operating assembly operable to manually control shifting of said locking component between said locked and unlocked positions, and said catch including a safety operable to prevent said component from shifting to said locked position when said catch is in said disengaged position.

* * * * *